US006601794B2

(12) United States Patent
Brutschin

(10) Patent No.: US 6,601,794 B2
(45) Date of Patent: Aug. 5, 2003

(54) CABLE DRUM

(75) Inventor: Ralf Brutschin, Grenzach-Wyhlen (DE)

(73) Assignee: Rotzler GmbH & Co. KG, Steinen (DE)

( * ) Notice: Subject to any disclaimer, the term of this patent is extended or adjusted under 35 U.S.C. 154(b) by 0 days.

(21) Appl. No.: 10/177,099

(22) Filed: Jun. 21, 2002

(65) Prior Publication Data

US 2003/0006337 A1 Jan. 9, 2003

(30) Foreign Application Priority Data

Jul. 5, 2001 (DE) ..... 101 32 611

(51) Int. Cl.[7] ..... B65H 75/08
(52) U.S. Cl. ..... 242/613; 242/602.1
(58) Field of Search ..... 242/613, 613.1, 242/609, 602.1, 903

(56) References Cited

U.S. PATENT DOCUMENTS

| | | | | | |
|---|---|---|---|---|---|
| 726,147 | A | * | 4/1903 | Dodge | 242/118 |
| 1,408,463 | A | * | 3/1922 | Miles | 242/608.4 |
| 1,555,544 | A | * | 9/1925 | Anthony | 242/587.1 |
| 1,822,422 | A | * | 9/1931 | Richardson | 242/602.2 |
| 1,984,604 | A | * | 12/1934 | Stahl | 254/278 |
| 2,330,086 | A | * | 9/1943 | Soffner | 34/625 |
| 3,266,748 | A | * | 8/1966 | Le Bus | 242/578.3 |
| 4,919,395 | A | * | 4/1990 | Ritter et al. | 266/103 |
| 5,335,883 | A | * | 8/1994 | Mawer | 242/602.1 |

FOREIGN PATENT DOCUMENTS

| | | |
|---|---|---|
| GB | 776007 | 5/1957 |
| WO | 86/01189 | 2/1986 |

OTHER PUBLICATIONS

M. Akiya et al., Patent Abstracts of Japan, Sep. 28, 1999, Publ. No. 11263592 A, Japan.
K. Mitsunori et al., Patent Abstracts of Japan, Jun. 17, 1997, Publ. No. 09156887 A, Japan.

* cited by examiner

*Primary Examiner*—William A. Rivera
(74) *Attorney, Agent, or Firm*—Gudrun E. Huckett

(57) ABSTRACT

A cable drum, having a substantially cylindrical drum body with drum walls arranged at its axial ends and a groove arrangement arranged on the drum body, enables winding of a cable in a rotational direction clockwise as well as counter-clockwise thereto. The groove arrangement has parallel areas in which the grooves are parallel to the circumferential direction and incline areas in which the grooves are slanted at an angle relative to the circumferential direction of the drum body. All grooves in the parallel areas have identical groove width. The grooves in the incline areas cross one another.

9 Claims, 2 Drawing Sheets

CABLE DRUM

BACKGROUND OF THE INVENTION

1. Field of the Invention

The invention relates to a cable drum comprising a substantially cylindrical drum body having drum walls arranged on its axial ends, and comprising a groove arrangement provided on the drum body which has at least one parallel area in which grooves extend parallel to the circumferential direction of the drum body and at least one incline area in which grooves are slanted about an angle relative to the circumferential direction of the cylindrical drum. All grooves in the parallel areas have the same groove width.

2. Description of the Related Art

From patent document GB 776,007 a cylindrical cable drum is known which has two areas with oppositely positioned grooves on its periphery, wherein the grooves are displaced relative to one another in the axial direction and have a length which is less than one half of the circumference.

Patent documents JP 09156887 A and JP 11263592 A disclose cable drums which have on both ends screw-shaped grooves with opposite orientation so that a cable is wound in axially opposite directions on both drum sides so that axial forces on the cable drum are reduced.

Patent document WO 86/01189 discloses a cable winding device with a cylindrical drum wherein the drum has first circumferential grooves at least about a portion of its periphery for receiving the innermost cable layer. Moreover, second grooves are provided which have a reduced diameter in comparison to the first grooves and which are capable of receiving an end strand which is connected to the innermost end of the cable but has a correspondingly reduced diameter. The second grooves are formed such in the base of the first grooves that the innermost cable layer is progressively unwound from the first end of the drum to the oppositely positioned second end and the end strand, after unwinding of the cable, is unwound progressively from the second end to the first end of the drum.

SUMMARY OF THE INVENTION

The invention has the object to provide a cable drum of the aforementioned kind with which a cable can be wound onto the drum in the clockwise direction as well as in a direction opposite thereto.

This object is solved by a cable drum of the aforementioned kind having grooves which cross one another the incline area.

The grooves which are crossing one another in the incline areas enable that a cable can be wound onto the drum in the clockwise direction as well as in a counter-clockwise direction. In this way, it is not necessary to provide different cable drums for different winding directions, as has been the case in the past. The cable drums according to the invention can be employed significantly more universally.

According to one embodiment of the invention, it is suggested that the pitch, i.e., the displacement of neighboring grooves in the longitudinal direction, matches approximately 1 to 1.1 times the diameter of the cable to be wound and that the grooves that are positioned adjacent to one another in the longitudinal direction of the cable drum contact one another. In this connection it is expedient that on the drum body two parallel areas and two incline areas are arranged. In this case, the parallel areas can have an axial displacement relative to one another which corresponds to half the pitch. In this way, for one winding of the cable about the drum a displacement is achieved which corresponds to 1 to 1.1 times the diameter of the cable so that the cable is wound tightly onto the drum. In an especially advantageous embodiment, the incline areas cover overall approximately 20% to 30% of the outer surface area of the drum body.

Moreover, in order to achieve a uniform winding action, it can be provided that in the parallel area filler wedges are arranged on one drum wall which prevent that a cable winding of the second cable layer wound at the drum wall is wound so as to have a diameter which is smaller than that of the second cable layer. A further embodiment of the invention provides that on a second drum wall a ramp wedge is provided which lifts the cable from a first cable layer onto a second cable layer.

BRIEF DESCRIPTION OF THE DRAWINGS

One embodiment of the invention will be explained in the following in more detail with the aid of the drawing. It is shown in.

DESCRIPTION OF PREFERRED EMBODIMENTS

Figure 1:
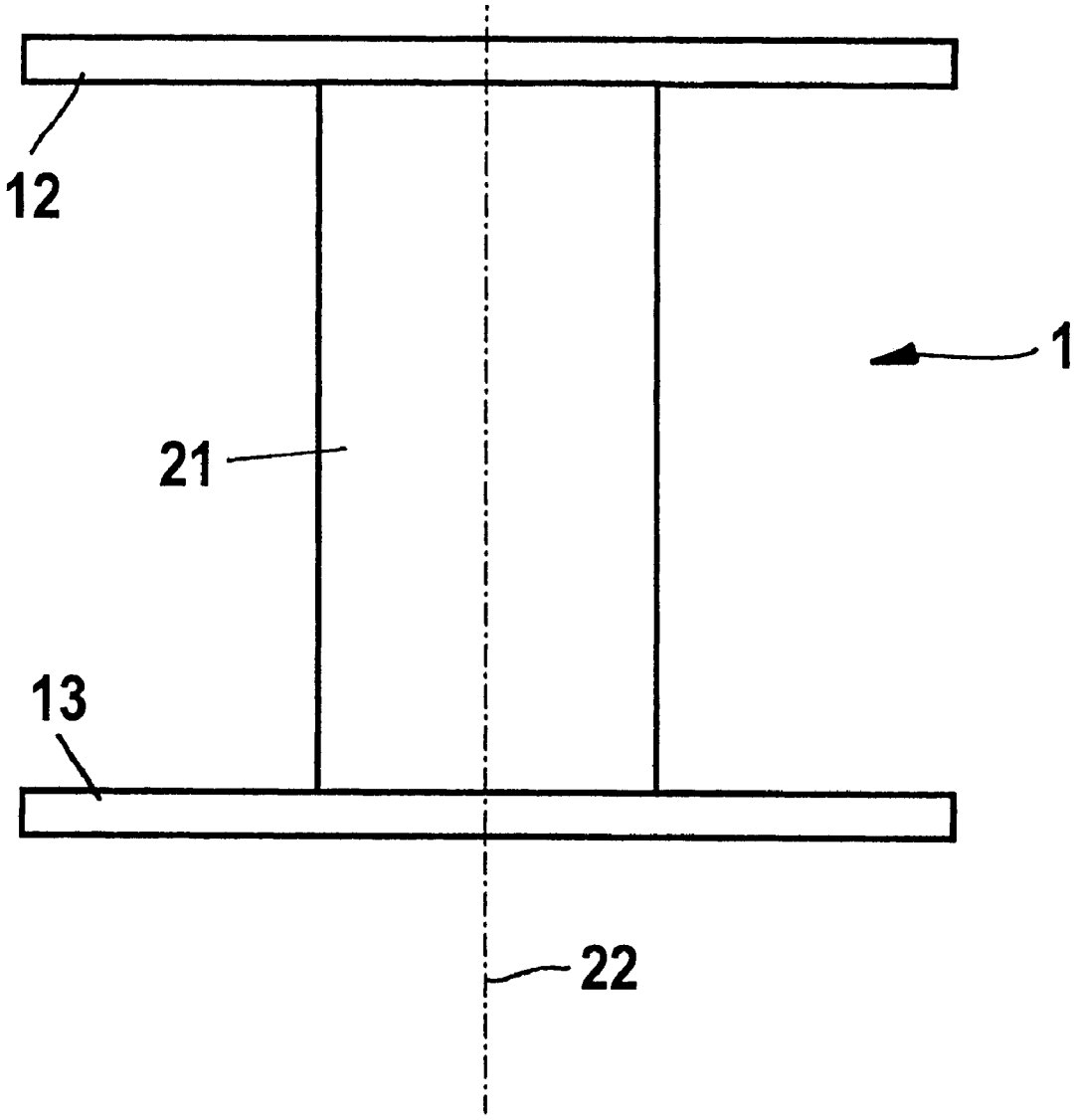
FIG. 1 a schematic illustration of a cable drum.

FIG. 1 shows a schematic illustration of a cable drum 1 with a drum axis 22, a drum body 21, an upper drum wall 12 and a lower drum wall 13. A cable can be wound onto the drum body 21 of the cable drum 1.

Figure 2:
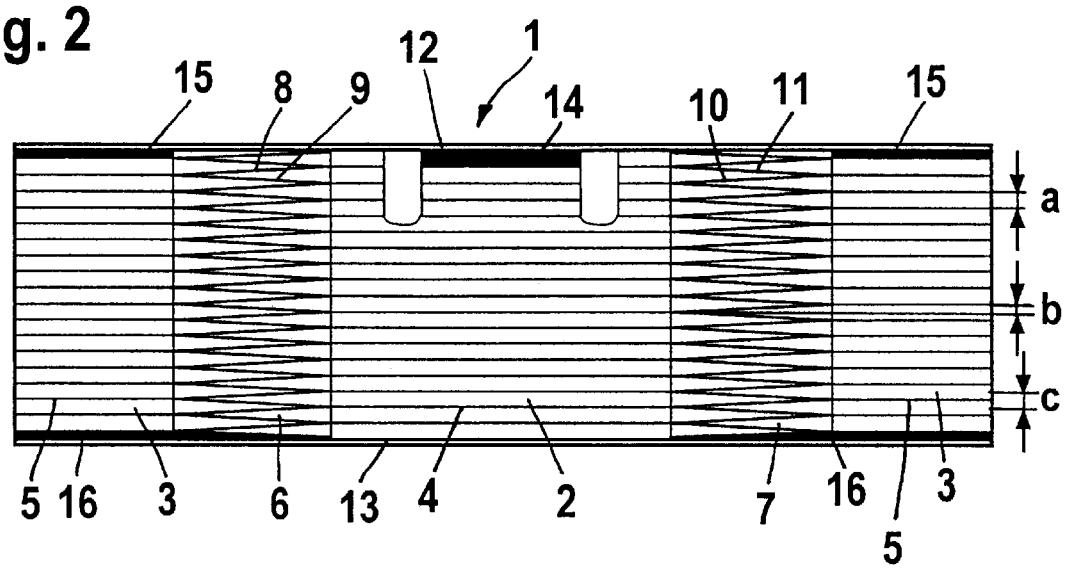
FIG. 2 a developed view of a groove arrangement of the drum body of the cable drum of FIG. 1.

In FIG. 2, a developed view of the drum body 21 of the cable drum 1 is illustrated wherein the cable body 21 is provided with a groove arrangement. The surface of the drum body 21 in the circumferential direction is divided parallel to the drum axis 22 into four areas: two parallel areas 2, 3 in which grooves 4 and 5 extend parallel to the drum walls 12 and 13 and two incline areas 6 and 7. The incline areas 6 and 7 have grooves 8 and 10 which are slanted at a positive angle to the horizontal and grooves 9 and 11 which are slanted at a negative angle to the horizontal. The parallel areas 2 and 3 cover approximately 35% to 40%, respectively, of the surface area of the drum body 21 and the incline areas 6 and 7 cover approximately 10% to 15%, respectively.

The grooves 4 and 5 in the parallel areas 2 and 3 have a width a. The pitch c by which the neighboring grooves 4, 5, 8, 9, 10, and 11 are displaced relative to one another in the longitudinal direction of the cable drum 1 matches approximately 1 to 1.1 times the diameter of the cable to be wound. Since the neighboring grooves 4, 5 contact or touch one another in the longitudinal direction of the cable drum 1 within the parallel areas 2, 3, the groove width a corresponds to the pitch c. The parallel areas 2, 3 are displaced in the axial direction by an axial displacement b which matches half the pitch c. The grooves 8, 9, 10, and 11 are slanted such that they adjoin with one end the grooves 4 of the parallel area 2 and with the other end adjoin the grooves 5 of the parallel area 3. The grooves 8 and 9 cross one another in the incline area 6 and the grooves 10 and 11 cross one another in the incline area 7, respectively. As a result of the axial displacement b of the parallel areas 2 and 3 relative to one another, the grooves 4 adjoin directly the upper drum wall 12 and the lower drum wall 13 while a spacing of the size of the displacement b is provided between the grooves 5 and the upper drum wall 12 and the lower drum wall 13.

At the location of this spacing, a filler wedge 14 is arranged in the parallel area 2 and a filler wedge 15 is arranged in the parallel area 3 at the upper drum wall 12. The filler wedge 14 has a width which matches the pitch c and the filler wedge 15 has a width which matches the axial displacement b. A ramp wedge 16 is arranged on the lower drum wall 13 and extends from the incline area 7 via the parallel area 3 to the incline area 6. The function of the filler wedges 14 and 15 and of the ramp wedge 16 will be explained infra.

Figure 3:
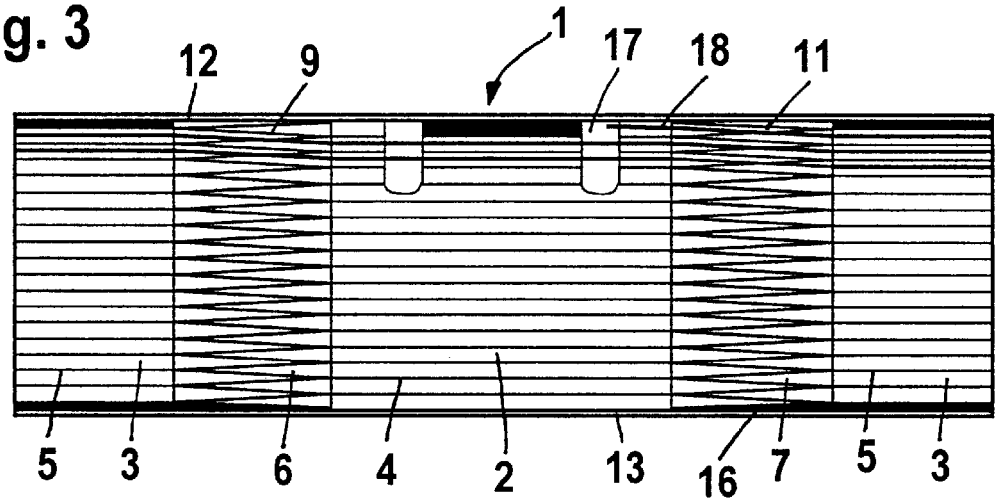
FIG. 3 the developed view of FIG. 2 with the cable path for a first rotational direction.

When winding the cable in a direction from the left to the right of FIG. 3, the cable extends along the cable path 18 from the cable inlet opening 17, where the end of the cable secured on the cable drum 1 exits from the interior of the drum body 21, via an upper groove 4 to the incline area 7, from there in a groove 11 to a groove 5, which is displaced downwardly by the displacement b, and via a groove 9 to the parallel area 2 where, after having been wound once about the drum body 21, it extends in a second groove 4 displaced downwardly by the pitch c relative to the upper groove 4. All further windings of the cable extend along a corresponding downwardly displaced cable path and thus form the first cable layer.

When the cable has reached the lowermost groove 4, it is lifted in the incline area 7 by the ramp wedge 16 onto a diameter which is larger by approximately twice the diameter of the cable so that a second cable layer can be wound onto the first cable layer. The second cable layer is wound in a direction counter to that of the first cable layer from the lower drum wall 13 toward the upper drum wall 12. As soon as the cable has reached the upper drum wall 12, the filler wedges 14 and 15 prevent that the cable can be wound into the spacing between the drum wall 12 and the upper cable winding of the first layer.

Figure 4:
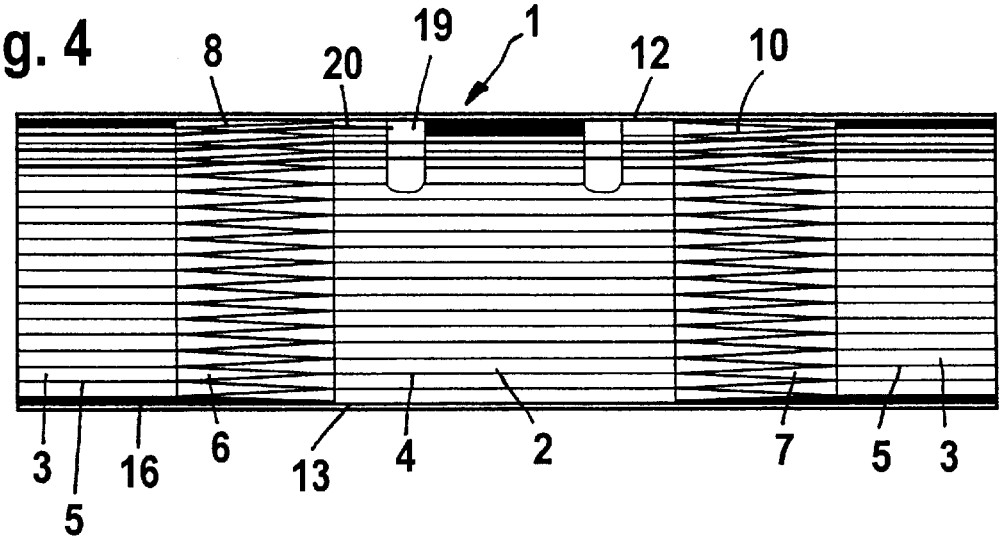
FIG. 4 the developed view of FIG. 2 with the cable path for a second rotational direction.

In FIG. 4 a cable path 20 is illustrated which results when winding the cable in the opposite rotational direction, i.e., when winding the cable in FIG. 4 from the right to the left. The cable extends from the cable inlet opening 19 via a groove 4 to groove 8 in the incline area 6, from there in a groove 5 in the parallel area 3 via a groove 10 in the incline area 7 to the parallel area 2 where, after having being wound once about the drum body 21, it extends in a groove 4 below the first groove 4.

As a result of the mirror-symmetrical configuration of the filler wedges 14 and 15 and of the ramp wedge 16 relative to the center of the parallel area 2 in which the inlet openings 17 and 19 are located, the function of the wedges is ensured for both rotational directions.

In another embodiment, the inlet openings 17 and 19 can be arranged in the upper drum wall 12 in the parallel area 2 wherein the inlet opening 17 adjoins the incline area 6 and the inlet opening 19 adjoins the incline area 7. With this embodiment, the filler wedge 14 is no longer needed because the cable rests against the upper drum wall 12 over the entire width of the parallel area 2.

While specific embodiments of the invention have been shown and described in detail to illustrate the inventive principles, it will be understood that the invention may be embodied otherwise without departing from such principles.

What is claimed is:

1. A cable drum comprising:

a substantially cylindrical drum body (21) having axial ends and drum walls (12, 13) arranged on the axial ends;

a groove arrangement provided on the drum body (21);

the groove arrangement comprising at least one parallel area (2, 3) and at least one incline area (6, 7), wherein the at least one parallel area (2, 3) consists of first grooves (4, 5) and the at least one incline area (6, 7) consists of second grooves (8, 9, 10,11), wherein the first grooves (4, 5) extend parallel to a circumferential direction of the drum body (21) and wherein the second grooves (8, 9, 10, 11) are slanted by an angle relative to the circumferential direction of the drum body (21);

wherein all of the first grooves (4, 5) have an identical groove width (a); and wherein the second grooves (8, 9, 10, 11) within the at least one incline area (6, 7) cross one another such that winding of a cable onto the cable drum is enabled in a clockwise direction and a counterclockwise direction.

2. A cable drum according to claim 1, wherein a pitch (c), defined as a displacement between the first and second grooves (4, 5, 8, 9, 10, 11) neighboring one another, respectively, in a longitudinal direction of the drum body (21), matches approximately 1 to 1.1 times a diameter of a cable to be wound onto the drum body (21).

3. A cable drum according to claim 2, wherein the first and second grooves (4, 5, 8, 9, 10, 11) neighboring one another contact one another in the longitudinal direction of the drum body (21).

4. A cable drum according to claim 2, wherein two of the parallel areas (2, 3) and two of the incline areas (6, 7) are arranged on the drum body (21).

5. A cable drum according to claim 4, wherein the two parallel areas (2, 3) have an axial displacement (b) relative to one another which matches approximately half the pitch (c).

6. A cable drum according to claim 1, wherein the one incline area (6, 7) cover approximately 20% to 30% of an outer surface area of the drum body (21).

7. A cable drum according to claim 1, wherein the second grooves (8, 9, 10, 11) in at least one incline area (6, 7) are slanted by an identical angle value relative to the circumferential direction of the drum body (21).

8. A cable drum according to claim 1, further comprising filler wedges (14, 15) arranged on a first one of the drum walls (12).

9. A cable drum according to claim 1, further comprising a ramp wedge (16) provided on a second one of the drum walls (13).

* * * * *